US008831467B2

(12) United States Patent
Higa

(10) Patent No.: US 8,831,467 B2
(45) Date of Patent: Sep. 9, 2014

(54) IMAGE-FORMING APPARATUS

(75) Inventor: Takuma Higa, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 165 days.

(21) Appl. No.: 13/422,391

(22) Filed: Mar. 16, 2012

(65) Prior Publication Data

US 2012/0237250 A1 Sep. 20, 2012

(30) Foreign Application Priority Data

Mar. 18, 2011 (JP) ..... 2011-060769

(51) Int. Cl.
*G03G 15/00* (2006.01)

(52) U.S. Cl.
USPC ..... 399/96

(58) Field of Classification Search
CPC ..... G03G 15/50; G03G 15/08; G03G 15/161; G03G 21/00; G03G 21/0064
USPC ..... 399/127
See application file for complete search history.

(56) References Cited

U.S. PATENT DOCUMENTS

| | | | | |
|---|---|---|---|---|
| 4,578,331 | A * | 3/1986 | Ikeda et al. | 430/42.1 |
| 2001/0012594 | A1* | 8/2001 | Ri et al. | 430/58.7 |
| 2007/0098442 | A1* | 5/2007 | Shishido et al. | 399/127 |
| 2010/0303515 | A1* | 12/2010 | Kitagawa | 399/302 |
| 2011/0229820 | A1 | 9/2011 | Higa | |

FOREIGN PATENT DOCUMENTS

| | | | |
|---|---|---|---|
| JP | 58-070242 | A | 4/1983 |
| JP | 59-081662 | A | 5/1984 |
| JP | 07-134453 | A | 5/1995 |
| JP | 2006-251263 | A | 9/2006 |
| JP | 2009-069208 | A | 4/2009 |
| JP | 2009-145704 | A | 7/2009 |

OTHER PUBLICATIONS

Translation of Yoshiki (JP 2009145704 A, pub date: Jul. 2, 2009).*

* cited by examiner

*Primary Examiner* — Walter L Lindsay, Jr.
*Assistant Examiner* — Frederick Wenderoth
(74) *Attorney, Agent, or Firm* — Harness, Dickey & Pierce, P.L.C.

(57) ABSTRACT

An image-forming apparatus, comprising: a rotatable photoreceptor; a charging device configured to charge a surface of the photoreceptor to be a target charge potential; an exposure device configured to expose a charged portion on the surface of the photoreceptor to form an electrostatic latent image; a developing device configured to develop the electrostatic latent image using toner to form a toner image; a transfer device configured to apply a transfer bias between the photoreceptor and a transfer member by applying an electrical potential of opposite polarity to the target charge potential to the transfer member facing the photoreceptor, and which transfers the toner image on the photoreceptor onto a body to be transferred by the transfer bias; a neutralization device configured to neutralize the surface of the photoreceptor by irradiating the surface with neutralization light after the transferring; and a pre-rotation device configured to perform a pre-rotation process.

9 Claims, 7 Drawing Sheets

IMAGE-FORMING APPARATUS

CROSS REFERENCE TO RELATED APPLICATIONS

Priority is claimed on Japanese Patent Application No. 2011-060769, filed with the Japanese Patent Office on Mar. 18, 2011, the content of which is incorporated herein by reference.

BACKGROUND OF THE INVENTION

1. Field of the Invention

The present invention relates to image-forming apparatuses such as copying machines, facsimile machines, printers and so on, more particularly, image-forming apparatuses that have electrophotographic systems.

2. Description of Related Art

Conventionally, high quality images with long-term stability have been desired from image-forming apparatuses that have electrophotographic systems. In response to this, particularly, improvements have been made in terms of reliability and print quality of digital-copying machines or laser printers which convert image information into digital signals and form an electrostatic latent image with light to form an image.

From the viewpoint of improving the print quality and reliability, it is especially important to establish high image quality, high stabilization of the image (especially high abrasion resistance) and high stabilization of the photoreceptor.

As the photoreceptors, those using photosensitive organic materials have been widely used in general due to cost, productivity, low pollution, and so on.

As the photoreceptors using organic materials, the following are known: a photoreceptor using photoconductive resins as represented by polyvinyl carbazole (PVK); a photoreceptor using a charge-transfer complex as represented by PVK-TNF (2,4,7-trinitrofluorenone); a photoreceptor of a pigment dispersion-type using a binder as represented by a phthalocyanine binder; a photoreceptor of a functional separation-type used in combination with a charge-generating material and a charge-transport material, and so on.

In the photoreceptors using a photosensitive organic material, since the photosensitive layer has a low-molecular-weight charge-conveyance material and an inert polymer as the main components, the organic photoreceptors are generally flexible.

If the organic photoreceptor is used repeatedly in the electrophotographic process, there is a tendency for abrasion to be caused by a mechanical load of developing and cleaning systems.

If abrasion of the photosensitive layer progresses, the following are prone to be accelerated: reduction in charge potential of the photoreceptor; degradation of light sensitivity; scumming due to scratches on the photoreceptor; decrease in image density; and image degradation.

Accordingly, there is a need to improve abrasion resistance in the organic photoreceptor.

In particular, it is difficult to improve the abrasion resistance of the organic photoreceptor because of downsizing thereof due to downsizing and speeding up of the electrophotographic device.

Therefore, it is important to improve abrasion resistance.

From this viewpoint, the use of photoreceptors of a functional separation-type has increased due to their superior photosensitivity and durability characteristics. In addition, it is able to molecularly design a charge-generating material and a charge transport material individually and so on by selecting functional separation-type.

In a method of forming an electrostatic latent image using the photoreceptors of the functional separation-type, the photoreceptor surface is charged and irradiated with light, and this light passes through a charge conveyance layer to be absorbed into a charge-transport material disposed inside of a charge-generation layer.

An electric charge is then generated in the charge-generation layer. This electric charge is applied to the charge-conveyance layer at a boundary surface between the charge-generation layer and the charge conveyance layer.

The electric charge then moves through the charge conveyance layer via an electric field, which neutralizes the photoreceptor surface.

As a result, the electrical potential of the photoreceptor decreases at the irradiated position. The non-irradiated part of the photoreceptor surface that still has an electrical potential (residual potential) is an electrostatic latent image.

As a method to improve abrasion resistance of the photoreceptor, a method of adding fillers into the outermost periphery of the photoreceptor is widely known.

Another method using a charge-transport material of a polymer-type instead of using that of a low-molecular-weight-type (CTM) is also widely known.

However, there has been a problem as follows in an image-forming device having the photoreceptor with an abrasion resistance in its outermost periphery.

As shown in FIG. 16, there is a problem that the rotation number fails to increase up until the electric potential on the photoreceptor surface reach a target potential range that is close to a target charge potential.

If an image-forming process has been started before the charge potential on the photoreceptor surface charged (charge potential) reaches the target charge potential range, which results in a lack of the image density of a toner image, a deviation in the image density during the toner image formation. These problems cause a remarkably uneven image density in the toner image.

Therefore, a pre-rotation of the photoreceptor is carried out as an image-forming apparatus, for example, in JP2009-145704A. Namely, as an image-forming is carried out after waiting for the charge potential of the photoreceptor reaches the target charge potential range in general, the pre-rotation of the photoreceptor is carried out by rotating the photoreceptor while charging it with a charging device prior to the image-forming process.

In the pre-rotation process of the photoreceptor, if the rotation number of the photoreceptor (pre-rotation number) is set to be an unnecessary large number, which results in a short life of the photoreceptor.

Therefore, it is desirable to set the pre-rotation number of the photoreceptor in minimum necessary. For this purpose, the image-forming apparatus in JP2009-145704A performs a pre-rotation process with a pre-rotation number selected as the following.

Firstly, a range of appropriate pre-rotation numbers is predetermined from preset pre-rotation numbers in accordance with the total rotation number of the photoreceptor.

Next, a total rotation number, usage environment, and a print number of times of the photoreceptor are measured by measuring devices for the photoreceptor.

Then, the pre-rotation number appropriate for the pre-rotation process is selected from the range in terms of the measured data and the pre-rotation process is carried out.

The image-forming apparatus in JP2009-145704A determines the pre-rotation number from the next view point.

This view point is aiming for the image-forming process starts at timing early from the time point that the charge potential of the photoreceptor reaches the target charge potential range.

However, the present inventors found out, as a result of extensive studies, an image degradation problem is caused by a residual electrical potential (electrical potential of exposure section) fluctuating and unstable even after the electrical potential of the photoreceptor has reached the target charge potential range in a process of exposing to form the latent image on the charged photoreceptor surface.

FIG. 17 is a graph illustrating a relationship between rotation number of the photoreceptor in the pre-rotation process and the residual electrical potential.

As shown in FIG. 16, the electrical potential of the photoreceptor approaches the target charge potential gradually by increasing the pre-rotation number in the pre-rotation process.

Eventually, the charge potential (absolute value) of the photoreceptor reaches a predetermined reference potential or more to be within the target charge potential range.

On the other hand, as shown FIG. 17, the more the pre-rotation number of the photoreceptor in the pre-rotation process increases, the more amount of change in the residual electrical potential reduces gradually.

However, the pre-rotation number necessary to stabilize the residual electrical potential is larger than that necessary to let the charge potential reach the target charge potential range.

Therefore, as the image-forming apparatus in JP2009-145704A above, if the pre-rotation number of the photoreceptor is set so as to start image-forming at timing earliest possible from the time point that the charge potential reaches the target charge potential range, an image is formed before the residual electrical potential is stabilized.

If the amount of change in the residual electrical potential is large, an amount of change in an electrical potential for developing becomes also large and a toner concentration fluctuation becomes remarkable.

Therefore, if the image-forming process has been started before the residual electrical potential is stabilized, this results in problems to cause an image failure.

This problem is a lack of the toner concentration in a toner image or a toner concentration deviation in the toner image due to toner concentration fluctuation in the image-forming process.

However, in some of the image-forming apparatuses, there is an image-forming apparatus to apply a voltage with a polarity opposite to the target charge potential onto a transfer member facing the photoreceptor in order to apply a transfer bias between the photoreceptor and the transfer member.

Then, the image-forming apparatus transfers a toner image on the photoreceptor onto a body to be transferred such as an intermediate transfer body or a recording medium etc. due to the transfer bias.

As a result of a study by the present inventors, in such image-forming apparatuses as above, if the pre-rotation process is carried out in a condition of the transfer bias being applied, as shown in FIG. 18, the residual electrical potential does not change. It was confirmed that the problem described above does not occur.

It relates to that a charge (here assuming this charge is negative charge) on the photoreceptor surface charged by a charging process is neutralized by the transfer bias.

More specifically, a positive charge is applied to the photoreceptor surface by a transfer current flowing by the transfer bias. Then, the negative charge on the photoreceptor surface which is charged by the charging process is neutralized by the positive charge.

Typically, an amount of the positive charge applied by the transfer bias is less than that of the negative charge by the charging process. Therefore, the negative charge remains on the photoreceptor surface even after the neutralization by the transfer bias.

Here, if a charge potential on the photoreceptor surface has already reached the target charge potential range, a charge potential on the photoreceptor surface in the next charging process reaches an electrical potential nearly equal to that in the previous time (the target charge potential).

Therefore, the amount of the negative charge remaining on the photoreceptor surface after the charging process in the second time is equal to that in the first time.

After that, the amount of positive charge applied by the transfer bias is equal to that in the previous time. Therefore, the amount of the negative charge remaining on the photoreceptor surface after neutralization by the transfer bias is also equal to that in the previous time.

In summary, if the charging process and applying the transfer bias are repeated, there is no stack of the charge on the photometer surface. Therefore, the residual electrical potential on the photoreceptor surface does not change.

On the other hand, a case will be explained that the pre-rotation process of the photoreceptor is carried out while irradiating and neutralizing the photoreceptor surface with neutralization light.

As well as a method of forming an electrostatic latent image, the positive charge generated by neutralization light moves to the photoreceptor surface due to a potential difference with the negative charge on the photoreceptor surface charged by a charging process.

Then, a positive electric field moved to the photoreceptor surface counteracts the negative charge on the photoreceptor surface and then the photoreceptor is neutralized.

In this case, the positive charge is trapped into the layer of the photoreceptor in the course of the movement of the positive charge. Then, the trapped positive charge is accumulated gradually and the residual electrical potential on the photoreceptor surface gradually increases.

An increased amount (the amount of change) of the residual electrical potential by this positive charge trap is decreasing with a progressive increase in the number of repeating the neutralization by the neutralization light and the charging process.

The residual electrical potential stabilizes before too long. However, it requires a considerable pre-rotation number of times until the residual electrical potential stabilizes as described above.

Moreover, in addition, in a case that a pre-rotation process is carried out while irradiating and neutralizing the photoreceptor surface with the neutralization light under a condition of applying the transfer bias, the residual electrical potential does not change and the problem described above does not occur.

This reason is as follows. Even if the neutralization with the light is carried out against the photoreceptor surface after applying the transfer bias to it, there is little negative charge on the photoreceptor surface due to a neutralization effect by the transfer bias, so that the positive charge generated in the photoreceptor layer does not move to the photoreceptor surface.

SUMMARY OF THE INVENTION

An object of the present invention is to suppress an aging of the photoreceptor by the pre-rotation process, and provide an image-forming apparatus capable of suppressing a degradation of image quality caused by starting the image-forming process before the residual potential is stabilized.

To accomplish the object, an image-forming apparatus according to the present invention has a rotatable photoreceptor; a charging device configured to charge a surface of the photoreceptor to be a target charge potential an exposure device configured to expose a charged portion on the surface of the photoreceptor to form an electrostatic latent image; a developing device configured to develop the electrostatic latent image using toner to form a toner image; a transfer device configured to apply a transfer bias between the photoreceptor and a transfer member by applying an electrical potential of opposite polarity to the target charge potential to the transfer member facing the photoreceptor, and which transfers the toner image on the photoreceptor onto a body to be transferred by the transfer bias; a neutralization device configured to neutralize the surface of the photoreceptor by irradiating the surface with neutralization light after the transferring; and a pre-rotation device configured to perform a pre-rotation process which rotates and drives the photoreceptor without applying the transfer bias while performing the charging process by the charging device and the neutralization process by the neutralization device before the forming the electrostatic latent image by the exposure device, and to maintain the pre-rotation process up to the number of rotation times in which an absolute value of the charge potential of the photoreceptor becomes a first predetermined reference value or more, the pre-rotation device maintains the pre-rotation process up to the number of rotation times in which a temporal change in the charge potential of the photoreceptor becomes a second predetermined reference value or less after reaching the number of rotation times in which the absolute value of the charge potential of the photoreceptor becomes the first predetermined reference value or more.

DETAILED DESCRIPTION OF THE PREFERRED EMBODIMENTS

Hereinafter, one Embodiment according to the present invention will be explained, where the present invention is applied to an image-forming apparatus with an electrophotographic system.

Figure 1:
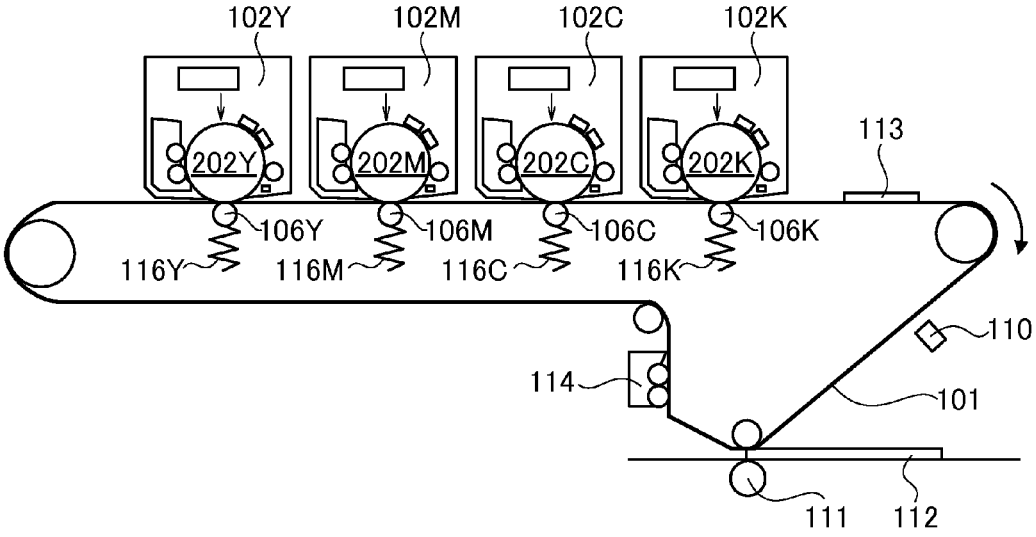
FIG. 1 shows a skeleton framework of the main section of a printer in Embodiment.

FIG. 1 is a schematic illustration on the main part of the printer as the image-forming apparatus according to the present Embodiment.

As shown in FIG. 1, image-forming sections 102Y (Yellow), 102M (Magenta), 102C (Cyan) and 102K (Black) are provided along an intermediate belt 101 as intermediate transfer body. This intermediate belt 101 is a body onto which an image is transferred. The intermediate belt 101 is being stretched by a plurality of tension rollers.

Toner images formed by the image-forming sections 102Y, 102M, 102C and 102K are transferred to the intermediate belt 101 respectively by first transfer devices 106Y, 106M, 106C and 106K, respectively.

Devices 116Y, 116M, 116C and 116K (hereinafter referred to as "first transfer retractor") as contact-separating devices are provided in the lower portion of the transfer devices 106Y, 106M, 106C, 106K, respectively.

The first transfer retractors 116Y, 116M, 116C and 116K contact and separate the first transfer devices 106Y, 106M, 106C, 106K against the intermediate belt 101, respectively.

The intermediate transfer belt 101 is pushed toward the photoreceptors 202 by the first transfer retractors 116Y, 116M, 116C and 116K respectively through the first transfer devices 106Y, 106M, 106C and 106K between the intermediate transfer belt 101 and the first transfer retractors 116Y, 116M, 116C and 116K respectively.

An image-detection device 110 as a toner adhesion amount detection device is provided at a position facing the intermediate belt 101. This image-detection device detects a toner adhesion amount of the toner image that is transferred onto the intermediate belt 101.

The toner image on the intermediate belt 101 is transferred onto a recording sheet 112 as a recoding medium by the second transfer device 111.

Figure 2:
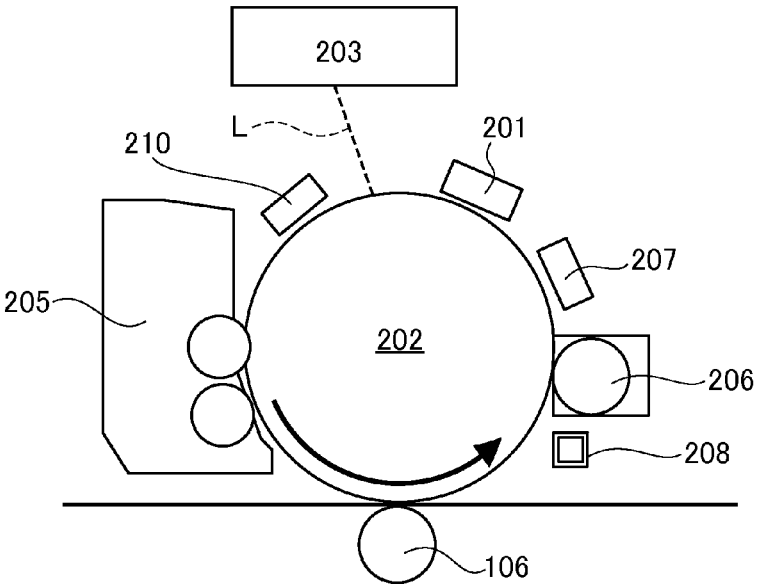
FIG. 2 shows a skeleton framework of the image-forming section of the printer in FIG. 1.

FIG. 2 is showing a schematic configuration of the image-forming sections 102Y, 102M, 102C, 102K. Moreover, each configuration of the image-forming sections 102Y, 102M, 102C, 102K is almost the same in as the others except color differences, so that hereinafter it will be explained as one image-forming section without differentiating from the others.

A charging device 201 configured to charge a photoreceptor surface negatively is provided around a photoreceptor 202.

A writing device (exposure device) 203 is provided around the photoreceptor 202, which exposes the photoreceptor surface with light L for writing, and lowers the electrical potential on the photoreceptor surface in order to form an electrostatic latent image.

A developing device 205 is provided around the photoreceptor 202, which develops the latent image using a charged toner of negative polarity.

A photoreceptor cleaner 206 is provided around the photoreceptor 202, which cleans a residual toner etc. on the photoreceptor surface after the transferring.

An eraser 207 as a neutralization device is provided around the photoreceptor 202, which irradiates the photoreceptor surface with neutralization light in order to neutralize an electrical charge on the photoreceptor surface.

A voltage sensor 210 as a measuring device is provided around the photoreceptor 202.

The photoreceptor 202 according to the present Embodiment is a photoreceptor of high hardness which contains filler on the photoreceptor surface.

Figure 3:
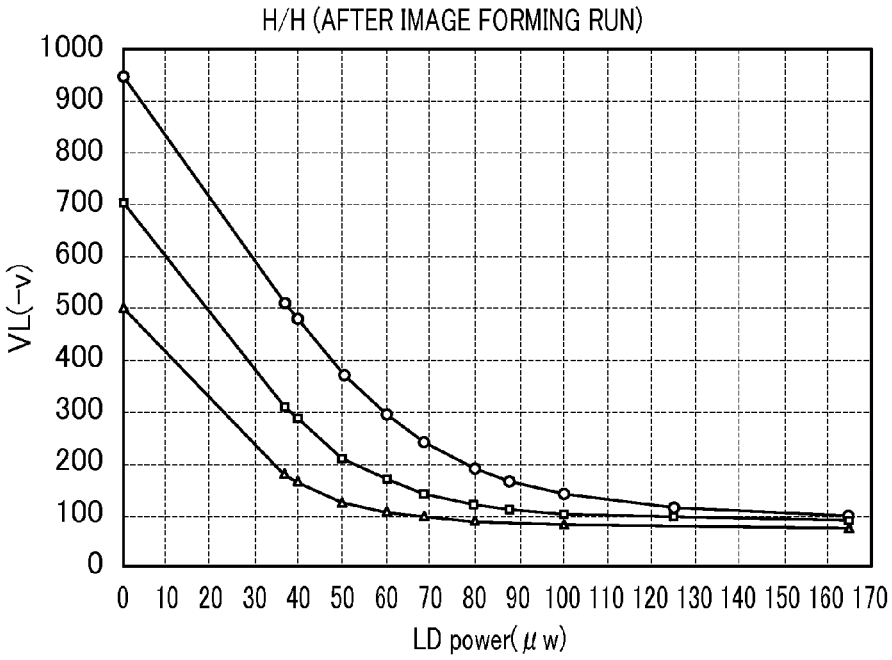
FIG. 3 is a graph showing one example of photosensitive properties of a photoreceptor under high temperature and high humidity (H/H), which photoreceptor is used for the printer in FIG. 1.
Figure 4:
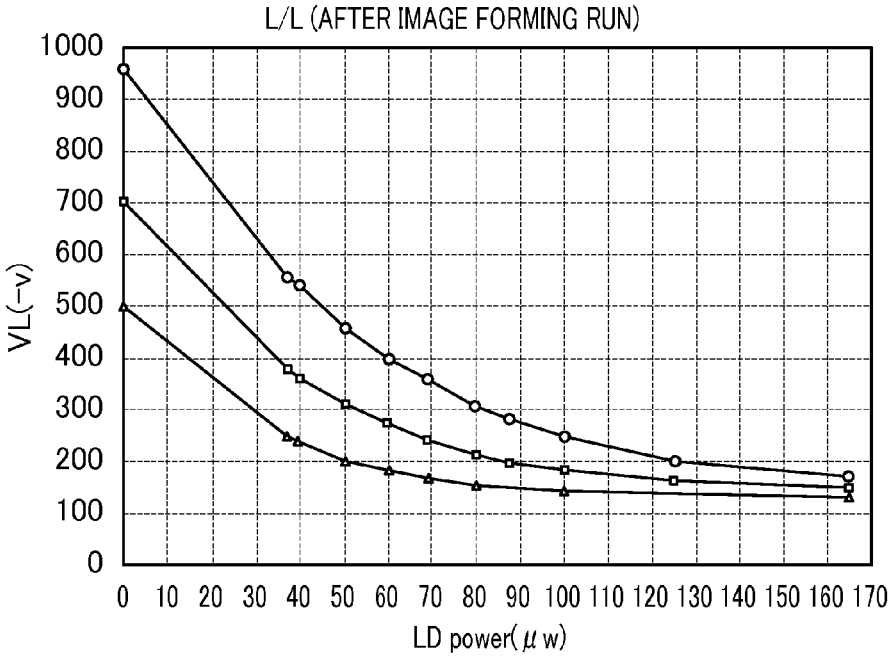
FIG. 4 is a graph showing one example of photosensitive properties of the photoreceptor under low temperature and low humidity (L/L), which photoreceptor is used for the printer in FIG. 1.

This photoreceptor has photosensitive properties such as shown in FIGS. 3, 4 that the rate of change in the residual electrical potential (of an exposure section) VL against the change in the exposure amount $LD_{power}$ gradually lowers according to the increase in the exposure amount. The photosensitive properties are as same as that of a photoreceptor without containing filler on the photoreceptor surface.

Figure 5:
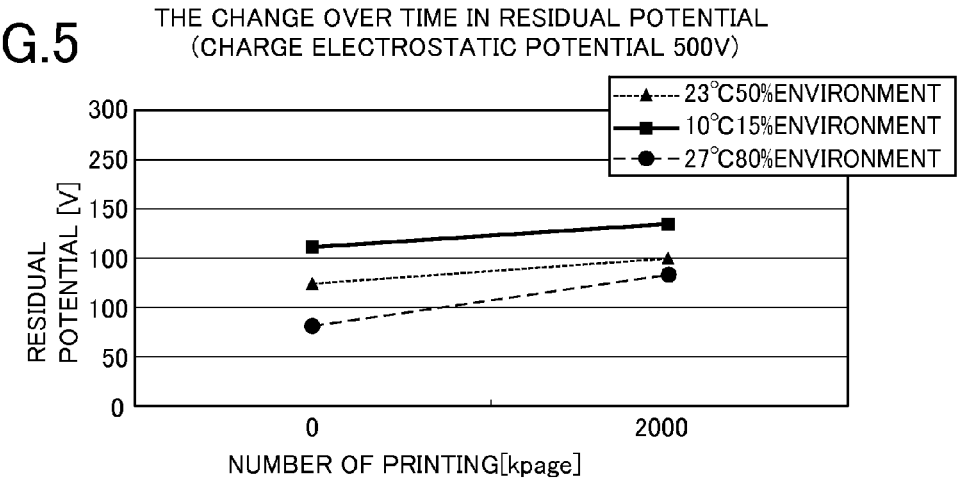
FIG. 5 is a graph showing one example of a temporal change in the residual electrical potential (of a latent image section) under conditions of high temperature and high humidity (27 cent degrees, humidity 80%), normal temperature and normal humidity (23 cent degrees, humidity 50%) and low temperature and low humidity (10 cent degrees, humidity 15%) respectively, and an absolute value of a charge potential of the photoreceptor is 500V.
Figure 6:
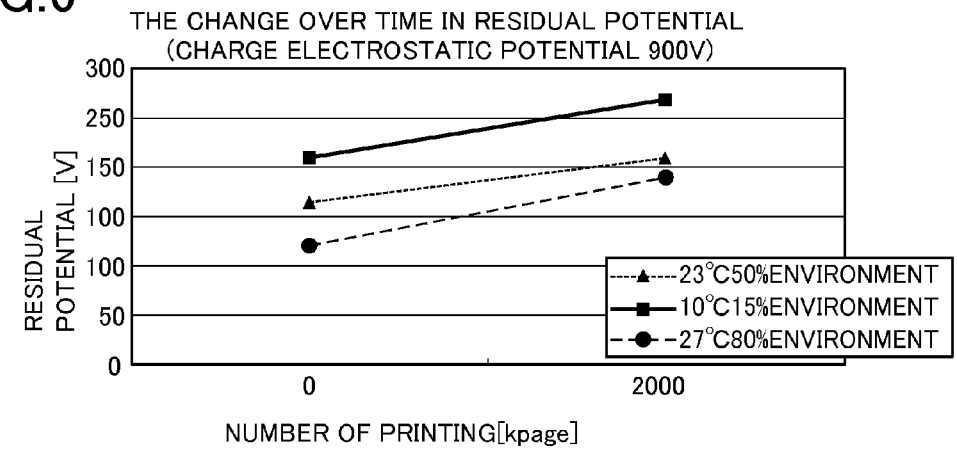
FIG. 6 is a graph showing one example of a temporal change in the residual electrical potential (of the latent image section) under conditions of high temperature and high humidity (27 cent degrees, humidity 80%), normal temperature and normal humidity (23 cent degrees, humidity 50%) and low temperature and low humidity (10 cent degrees, humidity 15%) respectively, and the absolute value of the charge potential of the photoreceptor is 900V.

As explanatory shown in FIGS. 5, 6, the photoreceptor according to the present Embodiment has another characteristic which the residual electrical potential (of the exposure section) VL as a target gradually increases over time.

Therefore, the photoreceptor 202 according to the present Embodiment is one that a relationship between the exposure amount $LD_{power}$ in a range for forming an image and the residual electrical potential (of the exposure section) VL changes over time dramatically.

The charging device 201 according to the present Embodiment is a charging device of non-contact-type composed of a wire for corona discharge not shown in the figures and a grid electrode facing the wire.

It is configured that the charge potential on the surface of the photoreceptor 202 is set to be a target charge potential (of minus charge in the present Embodiment) by setting a grid voltage (charging bias) at the grid electrode to the target charge potential.

Moreover, it is acceptable to use another charging device of non-contact or contact-type instead of the charging device 201.

The writing device 203 according to the present Embodiment irradiates the photoreceptor with writing light L of repeating pulses, namely, intermittent writing light L by using a laser diode (LD) as the light source, then an electrostatic latent image by dot is formed on the photoreceptor surface.

In the present Embodiment, an amount of the toner adhered to the electrostatic latent image by dot is controlled by changing an exposure time (exposure time unit) at forming the electrostatic latent image by dot in order to accomplish a gradation control.

In the present Embodiment, a maximum exposure time unit is divided into 15 sections (hereinafter, the respective exposure time unit is referred as "exposure duty"), so that it is possible to do a 16-levels gradation control. Therefore, it is possible to adjust the exposure duty at 16 levels, from 0 (no exposure) to 15 (maximum exposure time unit) in the present Embodiment.

The developing device 205 according to the present Embodiment has a developing roller as a developer bearing member. This developing device 205 is arranged at a position facing the photoreceptor surface.

The developing device 205 supplies the toner carried on the developing roller to the photoreceptor surface.

The developer is composed of two-component of the toner and its magnetic carrier. The toner is being charged at a predetermined polarity (minus polarity in the present Embodiment).

The developing roller is being applied with a developing bias Vb. This developing bias Vb is sufficiently smaller than the charge potential (electrical potential at non-exposed portion). An absolute value of the developing bias Vb is sufficiently larger than the electrical potential of the exposure section VL.

Herewith, it is possible to form an electric field in a developing region where the photoreceptor surface and the developing roller face each other.

The electric field moves the toner to the electrostatic latent image on the photoreceptor surface but does not move the toner to a non-electrostatic latent image (no-exposure section) on the photoreceptor surface. Then, the electrostatic latent image is developed by toner.

Firstly, the charging device 201 charges the photoreceptor surface such that the entire photoreceptor surface uniformly becomes a target charge potential (of minus polarity) in an image-forming process.

Next, the writing device 203 irradiates (exposes) a portion of the surface of the charged photoreceptor 202Y with the writing light L emitted from the light source (LD) in accordance with image data.

Herewith, the charge potential (absolute value) at the exposed portion of the photoreceptor surface decreases and the electrostatic latent image is formed thereon.

After that, the electrostatic latent image (=the exposed portion in the present Embodiment) on the surface of the photoreceptor 202 is developed to the toner image by the toner carried on the developing roller of the developing device 205.

More specifically, a developing bias Vb is applied to the developing roller. The absolute value of the developing bias Vb is larger than the charge potential of the exposure section VL and is smaller than the charge potential Vd. The toner being charged at a predetermined potential (minus polarity in the present Embodiment) adheres to the electrostatic latent image electrostatically to develop it.

The toner image formed on the photoreceptor 202 is transferred onto the intermediate belt 101 by the first transfer devices 106. The residual toner not transferred and remaining on the photoreceptor 202 is recovered by the photoreceptor cleaner 206.

The eraser 207 irradiates the photoreceptor surface uniformly by the neutralization light after the toner image is transferred onto the intermediate belt 101. Herewith, a portion of non-electrostatic latent image (no-exposure section) is neutralized, and then the photoreceptor surface is neutralized uniformly.

In this way, toner images by colors Y, M, C, K respectively are formed by the image-forming sections 102Y, 102M, 102C, 102K respectively. Then, the toner images are transferred onto the intermediate belt 101 so as to overlap each other, one by one.

After that, the toner image on the intermediate belt 101 by the colors is transferred onto a transfer sheet 112 by the second transfer device 111.

Then, the toner image on the transfer sheet 112 is fixed thereon by a fixer not shown in the figures, and the image-forming process is finished.

Figure 7:
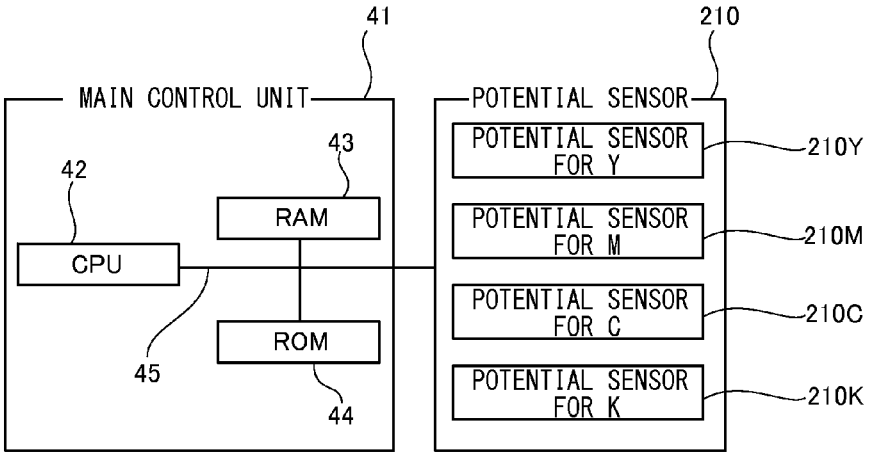
FIG. 7 is a block diagram showing an electrical connection in parts of the same printer in FIG. 1.

FIG. 7 is a block diagram showing an electrical connection in parts of the printer in the present Embodiment.

As shown in FIG. 7, a main control unit 41 composed of a computer is provided in the printer according to the present Embodiment. This unit 41 drives and controls various parts in the printer.

The main control unit 41 is composed of a CPU (Central Processing Unit) 42, a ROM (Read Only Memory) 44 and a RAM (Random access memory) 43 connected to the CPU 42 through a bus line 45 respectively.

The RAM 43 is used as a working area for memorizing data readable and rewritable freely or used as others. The CPU 42 performs various operations, and also drives and controls various parts in the printer. The ROM 44 stores in advance a fixed data, such as computer programs.

The main control unit 41 is connected to the voltage sensors 210. The voltage sensors 210 (210Y, 210M, 210C, 210K) detect electrical potentials of the photoreceptors 202 (202Y, 202M, 202C, 202K) by the colors respectively.

Information from the detection by the voltage sensors 210 (210Y, 210M, 210C, 210K) is transmitted to the main control unit 41. The main control unit 41 is also connected to the charging device, the writing device and the developing device which are not shown in the figures.

The main control unit 41 memorizes the information on electrical potentials of the photoreceptors 202 from the detection by the voltage sensors 210.

The main control unit 41 has a function as a pro-rotation device configured to perform the pre-rotation process while timely changing a pre-rotation number, etc. of the photoreceptor 202 based on the memorized information.

Next, it will be explained on layers constituting the photoreceptor in the present Embodiment by referring FIGS. 8 to 12.

<Conductive Supporting Body>

As for a conductive supporting body 202A, it is acceptable to use a conductive supporting body with volume resistivity value less than $10^{10}$ [Ω cm]. For example, it is acceptable to use conductive supporting body obtained from coating a roll or film shape of plastic or paper member with a metal or a metal oxide by sputtering or evaporation coating.

This metal is, for example, aluminum, nickel, chromium, dichromate, copper, gold, silver, platinum or the like. The metal oxide is, for example, tin oxide, indium oxide, or the like.

It is also acceptable to use a metal plate such as one made of, for example, aluminum, aluminum alloy, nickel, stainless steel, or the like.

It is also acceptable to use a tube member etc. obtained by forming an element tube with construction methods such as extruding, drawing etc. the metal plate above or them, and cutting, super finishing, polishing, etc. the element tube.

It is also acceptable to use a member obtained by coating the conductive supporting body with an adhesive resin which is dispersed with a conductive powder.

As this conductive powder, it is acceptable to use carbon black, acetylene black. It is also acceptable to use a metal powder of, for example, aluminum, nickel, iron, dichromate, copper, zinc, and silver or the like.

It is also acceptable to use a metal oxide powder of, for example, conductive tin oxide, ITO, or the like.

As for the adhesive resin used together with, it is acceptable to use thermoplastic resin, thermosetting resin or light-curing resin such as, for example, polystyrene, acrylonitrile-styrene copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyarylate resins, phenoxy resins, polycarbonate, cellulose acetate resin, ethyl cellulose resin, polyvinyl butyral, polyvinyl formal, polyvinyl toluene, poly-N-vinyl carbazole, acrylic resin, silicone resin, epoxy resin, melamine resin, urethane resin, phenol resin, alkyd resin or the like.

It is possible to provide a conductive layer like this by coating with a mixture obtained by dispersing these conductive powder and adhesive resin into an appropriate solvent such as, for example, tetrahydrofuran, dichloromethane, methyl ethyl ketone, toluene, or the like.

In addition, it is also possible to use a member as the conductive supporting body according to the present Embodiment well which is obtained by providing a conductive layer on a base substance in an appropriate cylinder shape by using a heat-shrinkable tube.

This tube is obtained by adding the conductive powder into materials such as, for example, polyvinyl chloride, polypropylene, polyester, polystyrene, polyvinylidene chloride, polyethylene, chlorinated rubber, teflon (registered trademark), or the like.

<Undercoat Layer>

In the photoreceptor according to the present Embodiment, it is acceptable to provide an undercoat layer (not shown in the figures) between the conductive supporting body 202A and a photoreceptive layer.

It is conventional for the undercoat layer to have a resin as the main component, but since the photoreceptive layer is coated over to this resin by using a solvent, it is desirable for the resin to have a high resistance to common organic solvents.

As this resin, it is acceptable to use water-soluble resins such as polyvinyl alcohol, casein, sodium polyacrylate, or the like. It is also acceptable to use alcohol soluble resins such as copolymer nylon, methoxymethylated nylon, or the like.

It is also acceptable to use curable resin to form a 3 dimensional network structure such as polyurethane, melamine resin, phenol resin, alkyd-melamine resin, epoxy resin or the like.

In addition, it is acceptable to add fine powder pigment of metal oxide to the undercoat layer, such as, for example, titanium oxide, silica, alumina, zirconium oxide, tin oxide, indium oxide or the like for preventing moiré, reducing the residual potential and so on.

It is possible to form the undercoat layer by using an appropriate coating method with an appropriate solvent like as forming the photoreceptive layer described above.

In addition, as the undercoat layer in the present Embodiment, it is acceptable to use a silane coupling agent, titanium coupling agent, chromium coupling agent or the like.

In addition, as the undercoat layer in the present Embodiment, it is acceptable to provide the undercoat layer with $Al_2O_3$ by anodic oxidation and use this undercoat layer well.

It is also acceptable to provide the undercoat layer with organic material such as poly-para-xylene (parylene) or the like or inorganic material such as $SiO_2$, $SnO_2$, $TiO_2$, ITO, $CeO_2$, or the like by making a thin-film under a vacuum state, and use this undercoat layer well.

It is also acceptable to provide and use an undercoat layer in the public knowledge. It is appropriate to set the thickness of the undercoat layer 0 to 5 micrometers.

<Photoreceptive Layer>

Next, it will be explained on the photoreceptive layer.

It is acceptable that the photoreceptive layer is single- or multi-layer. If the photoreceptive layer is multi-layer, the photoreceptive layer is composed of a charge generation layer 202C with a function of generating charge and a charge transport layer 202D with a function of transporting the charge.

If the photoreceptive layer is single-layer, the photoreceptive layer 202B has the two functions of generating and transporting the charge together. It will be explained on cases that the photoreceptive layer is the multi-layer and the single-layer, respectively.

<Case for the Photoreceptive Layer is Multi-Layer>

Figure 10:
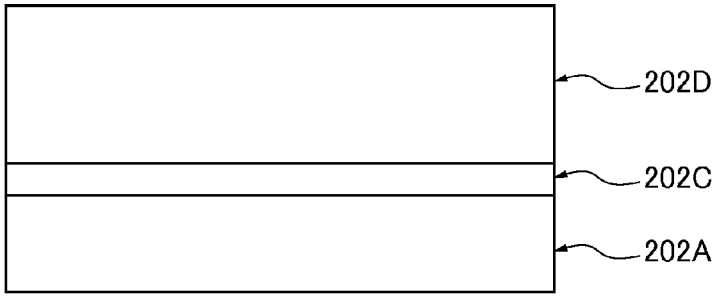
FIG. 10 is a schematic diagram showing a layer configuration of the photoreceptor with the photoreceptive layer being a multi-layer structure without any protective layer.

Next, it will be explained on a case that the photoreceptive layer is multi-layer by referring to FIGS. 10 and 12.

The charge generation layer 202C is mainly composed of the charge generating substance. It is possible to use the next charge generating substances in the public knowledge for the charge generation layer 202C.

As the representative, the charge generating substances are monoazo pigments, disazo pigments, trisazo pigments, perylene pigments, perinone pigments, quinacridone pigments, condensed polycyclic quinone compounds, squaric acid pigments, other phthalocyanine pigmeants, other naphthalocyanine pigments, azulenium salt pigments or the like. It is acceptable to use the charge generating substance alone or a mixture of them.

The charge generation layer 202C is formed by steps of (a) dispersing the charge generating substance into an appropriate solvent together with the adhesive resin as necessary by using a ball mill, an attritor, a sand mill, or a ultrasonic; (b) applying this mixture onto the conductive supporting body; and (c) drying this.

As the adhesive resin as necessary used for the charge generation layer 202C is polyamide, polyurethane, epoxy resin, polyketone, polycarbonate, silicone resin, acrylic resin, polyvinyl butyral, polyvinyl formal, polyvinyl ketone, polystyrene, polysulfone, poly-N-vinyl carbazole, polyacrylamide, polyvinyl vanzar, polyester, phenoxy resins, vinyl chloride-vinyl acetate copolymer, polyvinyl acetate, polyphenylene oxide, polyamide, polyvinyl pyridine, cellulose resins, casein, polyvinyl alcohol, polyvinyl pyrrolidone or the like.

It is appropriate to use 0 to 500 parts by weight, preferably 10 to 300 by weight of the adhesive resin against 100 parts by weight of the charge generating material. It is acceptable to add the adhesive resin to the solvent before or after the dispersing.

As the solvent to be used here, it is acceptable to use isopropanol, acetone, methyl ethyl ketone, cyclohexane, tetrahydrofuran, dioxane, ethyl cellosolve, ethyl acetate, methyl acetate, dichloromethane, dichloroethane, monochlorobenzene, cyclohexane, toluene, xylene, ligroin or the like, especially, ketone solvents, ester solvents, ether solvents are used well. It is acceptable to use the solvent alone or a mixture of them.

The charge generation layer 202C is mainly composed of the charge generating substance, the solvent and the adhesive resin. However, it is acceptable to mix any additive such as sensitizing agents, dispersants, surfactants, silicone oil or the like to the charge generation layer 202C.

As a coating method for the coating liquid, it is acceptable to use a method such as, dip coating, spray coating, beat coating, nozzle coating, spinner coating, ring coating or the like.

It is appropriate for the charge generation layer 202C to have the layer thickness in a range 0.01 to 5.00 micrometers, preferably 0.10 to 2.00 micrometers.

On the other hand, the charge transport layer 202D is formed by steps of (a) dispersing and/or dissolving the charge transporting substance and the adhesive resin into the appropriate solvent together; (b) applying this mixture onto the charge generation layer 202C; and (c) drying this.

In addition, it is also acceptable to add a plasticizer, a leveling agent, an antioxidant or the like sorely or in combination with the others as necessary.

As the adhesive resin, it is acceptable to use thermoplastic resin or thermosetting resin such as ABS resin, ACS resin, olefin-vinyl monomer copolymer, chlorinated polyether, aryl resins, phenolic resins, polyacetal, polyamide, polyamide imide, polyacrylate, poly-allyl sulfone, polybutylene, polybutylene terephthalate, polycarbonate, polyether sulfone, polyethylene, polyethylene terephthalate, polyimide, acrylic resin, poly methyl pentene, polypropylene, polyphenylene oxide, polysulfone, polystyrene, polyarylate, AS resin, butadiene-styrene copolymer, polyurethane, polyvinyl chloride, polyvinylidene chloride, epoxy resin, styrene-acrylonitrile copolymer, styrene-maleic anhydride copolymer, polyester, vinyl chloride-vinyl acetate copolymer, polyvinyl acetate, phenoxy resin, cellulose acetate resin, ethyl-cellulose resin, polyvinyl butyral, polyvinyl formal, polyvinyl toluene, poly-N-vinyl carbazole, acrylic resin, silicone resin, melamine resin, alkyd resin or the like.

It is appropriate to use 20 to 300 parts by weight, preferably 40 to 150 parts by weight of the charge transporting substance against 100 parts by weight of the adhesive resin.

It is preferable for the charge transport layer to have the layer thickness under 25 micrometers in terms of resolution and response.

With respect to the lower limit of the layer thickness, it is preferable to set it 5 micrometers or more whereas the lower limit differs depending on image-forming system (charge potential etc.).

As the solvent to be used here, it is acceptable to use tetrahydrofuran, dioxane, toluene, dichloromethane, monochlorobenzene, dichloroethane, cyclohexanone, methyl ketone, acetone or the like.

It is acceptable to use the solvent sorely or in combination with the others. As a coating method for the coating liquid obtained as described above, it is acceptable to use a conventional method such as dip coating, spray coating, beat coating, nozzle coating, spinner coating, ring coating or the like.

<Case for the Photoreceptive Layer is Single-Layer>

Figure 8:
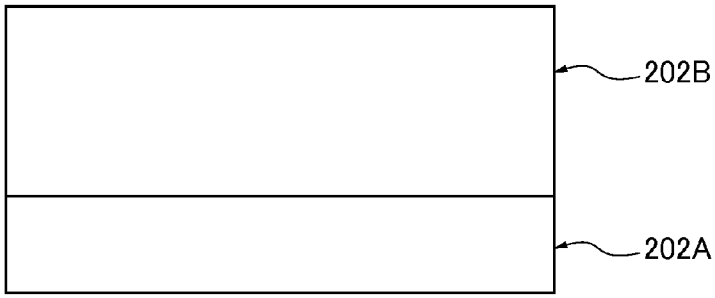
FIG. 8 is a schematic diagram showing a layer configuration of the photoreceptor with the photoreceptive layer being a single-layer structure without any protective layer.

Next, it will be explained on a case that the photoreceptive layer is single-layer by referring to FIGS. 8 and 9.

It is acceptable to use a photoreceptor with the adhesive resin dispersed with the charge generating and transporting substances above.

The photoreceptive layer is formed by steps of (a) dispersing and/or dissolving the charge generating substance, the charge transporting substance and the adhesive resin into the appropriate solvent together; (b) applying this mixture; and (c) drying this.

It is also acceptable to add a plasticizer, a leveling agent, an antioxidant or the like as necessary.

As the charge transporting substances, it is acceptable to use substances cited in the charge transporting layer. As the adhesive resin, it is acceptable to use not only the adhesive resins cited in the charge transport layer 202D previously, but also a mixture with/of the adhesive resin cited in the charge generation layer 202C.

It is appropriate to use 5 to 40 parts by weight of the charge generating substance against 100 parts by weight of the adhesive resin.

It is appropriate to use 0 to 190 parts, more preferably 50 to 150 parts by weight of the charge transporting substance against 100 parts by weight of the adhesive resin.

The photoreceptive layer is formed by dispersing the charge generating substance, the adhesive resin together with the charge transporting substance using a solvent such as tetrahydroflan, dioxane, dichloroethane, cyclohexane or the like by disperser or the like to obtain an coating liquid; and applying this coating liquid.

It is acceptable to use a method such as, dip coating, spray coating, beat coating, ring coating or the like for the coating.

It is appropriate to set the thickness of the photoreceptive layer in a range of 5 to 25 micrometers.

<Protective Layer 202E in the Photoreceptor>

Figure 9:
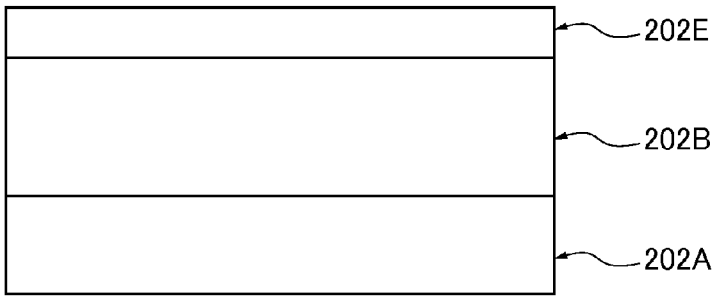
FIG. 9 is a schematic diagram showing a layer configuration of the photoreceptor with the photoreceptive layer being a single-layer structure with a protective layer.
Figure 11:
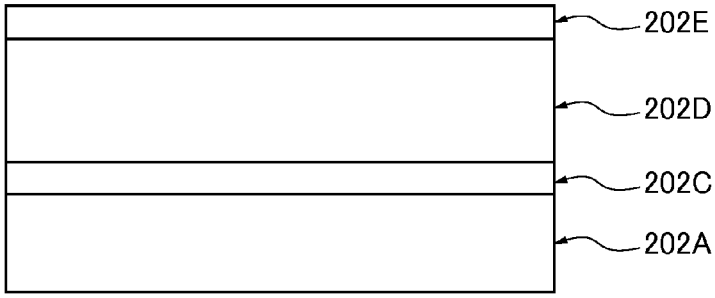
FIG. 11 is a schematic diagram showing one example of a layer configuration of the photoreceptor with the photoreceptive layer being a multi-layer structure with a protective layer.
Figure 12:
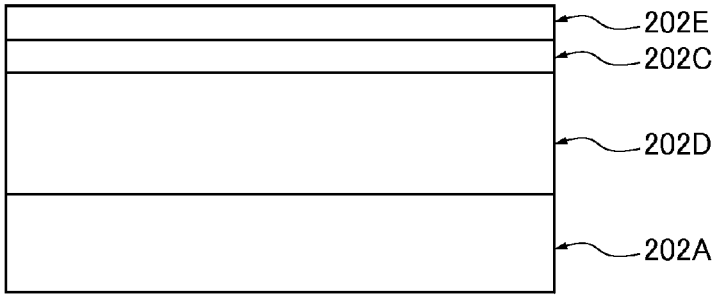
FIG. 12 is a schematic diagram showing another example of a layer configuration of the photoreceptor with the photoreceptive layer being a multi-layer structure with a protective layer.

Next, it will be explain on a case that the photoreceptor surface is a protective layer 202E by referring to FIGS. 9, 11 and 12.

The protective layer 202E as a periphery surface on the photoreceptor contains an amine compound. It is acceptable to add fillers to the protective layer 202E for a purpose of improving the abrasion resistance.

It is acceptable to add at least one species of organic compounds with 10 to 700 [mg KOH/g] of acid value into the protective layer 202E as a dispersing agent.

The fillers above are categorized to organic or inorganic fillers. As this organic filler, it is acceptable to use fluorine resin powder such as polytetrafluoroethylene powder, silicone resin powder, a-carbon powder or the like.

As the inorganic filler, it is acceptable to use metal powder of copper, tin, aluminum, indium, or the like.

It is also acceptable to use metal oxide such as titanium oxide, zinc oxide, zirconium oxide, iron oxide, chromium oxide, silica, tin oxide, alumina, zirconium oxide, indium oxide, antimony oxide, bismuth oxide, calcium oxide, antimony-doped tin oxide, tin-doped indium oxide or the like as the inorganic filler.

It is also acceptable to use metal fluorides such as tin fluoride, calcium fluoride, aluminum fluoride or the like as the inorganic filler.

It is also acceptable to use inorganic materials such as potassium titanate, boron nitrogen or the like as the inorganic filler.

It is advantageous to use the fillers of the metal oxide among these fillers for improving the abrasion resistance in terms of processing efficiency for the coating and hardness of the photoreceptor surface to be formed.

In addition, as the filler less likely to cause an image blur, it is preferable to use high electrical insulating filler. It is possible to use titanium oxide, alumina, zinc oxide, zirconium oxide or the like particularly effective. It is acceptable for those fillers to be used solely or combination with the other fillers.

Alpha alumina has hexagonal close-packed structure, so that Alpha alumina has a high abrasion resistance, a high insulation property and a high thermo-stability among these fillers, it is so useful of alpha alumina from the point of suppressing the image blur and improving the thermo-stability.

It is preferable to set the average primary particle diameter of the filler in a range of 0.01 to 1.0 micrometers, preferably 0.1 to 0.5 micrometers, more preferably 0.3 to 0.5 micrometers from the point of the abrasion resistance and light transmittance of the protective layer as the periphery surface.

If the average diameter of the primary particle in the filler is under 0.01 micrometers, it causes a reduction in the abrasion resistance, a reduction in dispersibility of the fillers and so on.

If the average diameter of the primary particle in the filler is 1.0 micrometers or more, there is a risk to progress a precipitation of the filler in the dispersion liquid and cause a filming of the toner and so on.

As the filler content, it is preferable in a range of 0.15 to 50% by weight, more preferably 5 to 30% by weight. If the filler content is under 0.1% by weight, the protective layer has an abrasion resistance but it is not sufficient. If the filler content is 50% or more by weight, there is a risk to cause a loss of the transparency of the protective layer.

These fillers are used in a manner of being dispersed in at least one species of dispersing agent. Herewith, it is effective for improving the dispersibility of the fillers and for suppressing the increase in the residual potential due to an addition of the filler.

A decrease in the filler dispersibility affects not only the increase in the residual potential, but also causes a reduction in transparency of the applied layer, a partial loss of the applied layer, further to a reduction in the abrasion resistance and so on. There is a risk to become a big obstacle for achieving higher image quality and resolution.

Next, it will be explained on organic compounds as this dispersing agent with the acid value in a range of 10 to 700 [mg KOH/g].

By containing the organic compounds with the acid value in a range of 10 to 700 [mg KOH/g], it is possible to prevent the increase in the residual electrical potential, "Acid value" is defined as "the number of milligrams of potassium hydroxide required to neutralize the free fatty acid in one gram of a fat, oil, resin, etc.".

As the organic compounds with the acid value in a range of 10 to 700 [mg KOH/g], it is acceptable to use organic compounds in the public knowledge such as organic fatty acids, resins highly oxidized and so on in so far as these organic compounds have the acid value in a range of 10 to 700 [mg KOH/g].

However, there is a possibility that the filler dispersibility is significantly reduced by acceptors or low-molecular-weight organic acids such as maleic acid, citric acid, tartaric acid, succinic acid or the like.

Therefore, it is not possible in some cases to obtain sufficiently the suppression effect on the increase in the residual electric potential.

Therefore, it is preferable to use low molecular weight polymer, resin, copolymer or the like solely or mixture of them in order to reduce the residual electrical potential of the photoreceptor and improve the filler dispersibility.

It is more preferable for the organic compounds to have a linear structure with less steric hindrance.

It is necessary for the both filler and adhesive resin to have an affinity to each other in order to improve the filler dispersibility.

Organic compound with a high steric-hinderance decreases the filler dispersiblity in accordance with a reduction of the affinity above, which causes many problems as described above.

From this view point, as the organic compounds with the acid value of 10 to 700 [mg KOH/g], it is preferable to use polycarboxylic acid. This polycarboxylic acid is a compound with a structure which carboxylic acid is contained inside of the polymer or copolymer.

For example, it is acceptable to use organic compounds containing carboxylic acid or the derivatives such as polyester resin; acrylic resin; copolymer using methacrylic or acrylic acid; acrylic copolymer containing phenolic hydroxy group, carboxyl styrene; or the like.

It is acceptable and useful to use these materials as a mixture of two or more. By mixing these materials with the organic acids, it sometimes increases the filler dispersiblity or even the reduction effect on the residual electrical potential in association with the increased filler dispersibility.

The organic compound with acid value of 10 to 700 [mg KOH/g] is used in the present Embodiment, but it is preferable to use organic compound with the acid value of 30 to 300 [mg KOH/g].

If the acid value is unnecessarily high, a resistance value too decreases, so that effects of image blur increases.

If the acid value is unnecessarily low, it is necessary to add a large amount of the organic compound and it is insufficient of the reduction effect on the residual electrical potential. It is necessary to determine the acid value of the organic compounds based on a valance with the addition amount.

Even if the same amount of the organic compounds is added, the organic compound with higher acid value does not always bring the higher reduction effect on the residual electrical potential. The reduction effect also has relates significantly to an adsorption of the organic compounds with acid value of 10 to 700 [mg KOH/g] to the filler.

It is possible to disperse the fillers together with at least an organic solvent and the organic compounds with acid value of 10 to 700 [mg KOH/g] and so on by using a conventional method with a ball mill, an attritor, a sand mill, a ultrasonic or the like, the fillers is to be contained in the protective layer 202E.

It is preferable to do the disperse by using the method with the ball mill from the points of views that impurities hardly contaminate into the ball mill from the outside and also it is possible to improve a contact efficiency of contacting the fillers to the organic materials with acid value of 10 to 700 [mgKOH/g].

As for material to be used for media, it is acceptable to use all the materials that have been used in the past such as zirconia, alumina, agate or the like.

From points of view on the filler dispersibility and the reduction effect on the residual electrical potential, it is especially preferable to use alumina as the material of the media.

If zirconia is used as the material, an amount of a media abrasion is large when dispersing, so that the residual potential significantly increases by an incorporation of the media.

Furthermore, the filler dispersibility decreases greatly depending on the incorporation of the worn media powder, and the filler sedimentation property increases.

If alumina is used as the material, even though the media is abraded away at dispersing, the amount of abrasion is low. In addition, the incorporated media powder from the abrasion affects little on the residual potential. If the media powder has been contaminated, it has less adverse effect on the filler dispersibility. Therefore, it is more preferable to use alumina as the media for the dispersion.

By adding the organic compounds with the acid value of 10 to 700 [mg KOH/g] together with the filler and/or the organic solvent the dispersion, it suppresses an aggregation of the fillers in a coating liquid and the sedimentation of the filler, and also improves the filler dispersibility remarkable. Therefore, it is preferable to add them before the dispersion.

On the other hand, it is acceptable to add the adhesive resin and charge transporting substance before the dispersion, but in this case, which sometimes results in a slightly decrease in the filler dispersibility. Therefore, it is preferable to add the adhesive resin and charge transporting material after the dispersion in a condition of being dissolved in the organic solvent.

For storing coating liquid containing compounds having an amine moiety and the organic compounds with the acid value of 10 to 700 [mg KOH/g], it is necessary for the coating liquid to contain an antioxidant in order to prevent the salt formation due to the interaction, If the salt is formed, the salt causes not only a discoloration of the coating liquid, but also defects such as an increase in the residual potential of a manufactured electrophotographic photoreceptor, and so on.

A cause for the instability in a temporal storage of the coating liquid due to the salt formation is stem from the structure of the compound having an amine moiety. It is possible to reduce the instability when coating by adding an antioxidant as shown in the next.

As the antioxidant to be contained in the coating liquid, it is acceptable to use conventional antioxidant as follows, but it is especially effective to use a hindered phenol compound. However, the antioxidant used here is only for a usage of protecting the compound having an amine moiety in coating unlike a purpose described later.

Therefore, it is preferable to add the antioxidant to the coating liquid before adding the compound having an amine moiety. As the addition amount, it is possible to obtain a sufficient preservation stability of the coating liquid over the storing time by an addition of 0.1 to 200% by weight of the antioxidant against the organic compounds with the acid value of 10 to 700 [mg KOH/g] in the coating liquid.

Next, it will be explained on the adhesive resin used for the protective layer 202E.

As the adhesive resin, it is acceptable to use thermoplasitic resin or thermosetting resin such as ABS resin, ACS resin, olefin-vinyl-monomer copolymer, chlorinated polyether, aryl resins, phenolic resins, polyacetal, polyamide, polyamide imide, polyacrylate, allyl sulfone, polybutylene, polybutylene terephthalate, polycarbonate, polyether sulfone, polyethylene, polyethylene terephthalate, polyimide, acrylic resin, poly methyl pentene, polypropylene, polyphenylene oxide, polysulfone, polystyrene, polyarylate, AS resin, butadiene-styrene copolymer, polyurethane, polyvinyl chloride, polyvinyl chloride vinylidene, epoxy resin, styrene-acrylonitrile copolymer, styrene-maleic anhydride copolymer, polyester, vinyl chloride-vinyl acetate copolymer, polyvinyl acetate, phenoxy resin, cellulose acetate resin, ethyl cellulose resin, polyvinyl butyral, polyvinyl formal, polyvinyl toluene, poly-N-vinyl carbazole, silicone resin, melamine resin, alkyd resin or the like.

In terms of the filler dispersibility, the residual electrical potential and partial loss of coating layer, it is preferable and useful to use polycarbonate or polyarylate.

<Intermediate Layer>

In the photoreceptor according to the present Embodiment, it is acceptable to provide an intermediate layer between the protective layer 202E and the photoreceptive layers 202B, 202C, 202D, although they are not shown in the figures.

For the intermediate layer, a binder resin is used as the main component in general. As these binder resins, it is acceptable to use polyamide, alcohol-soluble nylon, water-soluble polyvinyl butyral, polyvinyl butyral, polyvinyl alcohol or the like.

As a method of forming the intermediate layer, coating methods commonly used are adopted as described above. Moreover, it is appropriate for the thickness of the intermediate layer to be about 0.05 to 2 micrometers.

<Additives to Each Layer>

In the present Embodiment, for an improved environmental resistance, particularly, for preventions of an increase in the residual potential and loss of sensitivity, it is acceptable to add additives such as antioxidants, plasticizers, lubricants, ultraviolet absorbers, low-molecular-weight material for transporting charge, and a leveling agent to the charge generation layer, the charge transport layer, the undercoat layer, the protective layer, the intermediate layer, etc. respectively.

Representative materials for the additives are shown as follows.

It is acceptable to add following materials as an antioxidant to the respective layer above, but these materials are for example, it is not limited to them.

(a) Phenol compounds 2,6-di-tert-butyl-p-cresol,
Butylated hydroxyanisole,
2,6-di-tert-butyl-4-ethylphenol,
n-octadecyl-3-(4'-hydroxy-3',5'-di-tert-butylphenol),
2,2'-Methylene-bis-(4-methyl-6-tert-butylphenol),
2,2'-Methylene-bis-(4-ethyl-6-tert-butylphenol),
4,4'-Thiobis-(3-methyl-6-tert-butylphenol),
4,4'-Butylidene-bis-(3-methyl-6-tert-butylphenol),
1,1,3-Tris-(2-methyl-4-hydroxy-5-tert-butylphenyl) butane,
1,3,5-Trimethyl-2,4,6-tris-(3,5-di-tert-butyl-4-hydroxybenzyl)-benzene,
Tetrakis-[methylene-3-(3',5'-di-tert-butyl-4'-hydroxyphenyl)-propionate]methane,
Bis-[3,3'-bis-(4'-hydroxy-3'-tert-butylphenyl) butyric acid] glycol ester,
Tocopherols or the like.

(b) para-phenylenediamines:

N-phenyl-N'-isopropyl-p-phenylenediamine,
N,N'-Di-sec-butyl-p-phenylenediamine,
N-phenyl-N-sec-butyl-p-phenylenediamine,
N,N'-Di-isopropyl-p-phenylenediamine,
N,N'-Dimethyl-N,N'-di-tert-butyl-p-phenylenediamine, or the like.

(c) Hydroquinones:

2,5-di-tert-octyl-hydroquinone,
2,6-didodecyl hydroquinone,
2-dodecyl hydroquinone,
2-dodecyl-5-chloro-hydroquinone,
2-tert-octyl-5-methyl hydroquinone,
2-(2-octadecenyl)-5-methyl hydroquinone or the like.

(d) Organic sulfur compounds:

Dilauryl-3,3-thiodipropionate,
Distearyl-3,3'-dithio propionate,
Di-tetradecyl-3,3'-thiopropionate, or the like.

(e) Organic phosphorus compounds:

Tri-phenyl phosphine,
Tri-(nonyl-phenyl)phosphine,
Tri-(di-nonyl-phenyl)phosphine,
Tri-cresyl phosphine,
Tri-(2,4-di-butyl-phenoxy)phosphine or the like.

It is acceptable to add a plasticizer to each layer above. As this plasticizer, for example, it acceptable to use the following items, but the plasticizer is not limited to these items.

(a) Phosphoric acid ester-based plasticizer: Triphenyl phosphate, Tricresyl phosphate, Trioctyl phosphate, Octyl diphenyl phosphate, Trichloroethyl phosphate, Cresyl diphenyl phosphate, Tributyl phosphate, Tri-2-ethylhexyl phosphate, Triphenyl phosphate or the like.

(b) Phthalic acid ester plasticizers:

Di-methyl phthalate, Di-ethyl phthalate, Di-isobutyl phthalate, Di-butyl phthalate, Di-heptyl phthalate, Ethyl-hexyl-di-2-phthalic acid, Di-isooctyl phthalate, Di-n-octyl phthalate, Di-nonyl phthalate, Di-isononyl phthalate, Di-isodecyl phthalate, Di-undecyl phthalate, Di-tridecyl phthalate, Di-cyclohexyl phthalate, Butyl benzyl phthalate, Butyl lauryl phthalate, Methyl-oleyl phthalate, Octyl-decyl phthalate, Di-butyl fumarate, Di-octyl fumarate, or the like.

(c) Aromatic carboxylic acid ester-based plasticizers:

Tri-octyl trimellitate, Tri-n-octyl trimellitate, Oxy benzoic acid octyl or the like.

(d) Dibasic fatty acid ester-based plasticizers:

Di-butyl adipate, Di-n-hexyl adipate, Di-2-ethylhexyl adipate, Di-n-octyl adipate, N-octyl-n-decyl adipate, Di-isodecyl adipate, Di-caprylate adipate, Azlaic acid di-(2-ethylehexyl) ester, Di-methyl sebacate, Di-ethyl sebacate, Di-butyl sebacate, Di-n-octyl sebacate, Di-(2-ethylhexyl) sebacate, Di-(2-ethoxyethyl) sebacate,
Di-octyl succinate, Di-isodecyl succinate, Di-octyl-tetrahydro phthalate,
Di-n-octyl-tetrahydro phthalate, or the like.

(e) Fatty acid ester derivatives as plasticizers:

Butyl oleate, Glyceryl mono oleate ester, Methyl acetyl ricinolate, Penta-erythritol ester, Di-pentaerythritol-hexa ester, Triacetin, Tributyrin or the like.

(f) Oxy acid ester-based plasticizers:

Methyl acetyl ricinolate, Butyl acetyl ricinolate Butyl phthalyl butyl glycolate, Acetyl tributyl citrate or the like.

(g) Epoxy plasticizers:

Epoxidized soybean oil, Epoxidized linseed oil, Epoxystearic acid butyl ester, Epoxystearic acid decyl ester, Epoxystearic acid octyl ester, Epoxystearic acid benzyl ester, Epoxy hexa hydrophthalic acid dioctyl ester, Epoxy Hexa hydrophthalic acid didecyl ester, or the like.

(h) Divalent alcohol ester plasticizers: Diethylene glycol dibenzoate, Triethylene glycol-di-2-ethyl butyrate, or the like.

(i) Chlorine-containing plasticizers:

Chlorinated paraffin, Chlorinated diphenyl, Fatty acid methyl chlorination, Methoxy chlorinated fatty acid ester, or the like.

(j) Polyester plasticizers: Polypropylene adipate, Polypropylene sebacate, Polyester, Polyester acetylation, or the like.

(k) Sulfonic acid derivative as the plasticizer: p-toluene sulfonamide, o-toluene sulfonamide, p-toluene sulfonic ethyl amide, o-toluene sulfonic ethyl amide, Toluenesulfonic acid-N-ethylamide, p-toluene sulfonic acid N-cyclohexyl amide, or the like.

(l) Citric acid derivative as the plasticizer: Triethyl citrate, Acetyl citric acid triethyl ester, Tributyl citrate, Acetylcitric acid tributyl, Acetylcitric acid tri-2-ethylhexyl ester, Acetylcitric acid n-octyl-decyl ester, or the like.

(m) Other as the plasticizer: Terphenyls, Partially hydrogenated terphenyls, Camphor, 2-nitro-diphenyl, dinonyl naphthalene, abietic acid methyl, or the like.

It is acceptable to add a lubricant to each layer above. As this lubricant, for example, it acceptable to the following items, but the lubricant is not limited to these items.

(a) Hydrocarbon compounds: Liquid paraffin, paraffin wax, microcrystalline wax, polyethylene low polymerization, or the like.

(b) Fatty acid-based compounds: lauric acid, myristic acid, palmitic acid, Stearic, acid arachidic acid, behenic acid, or the like.

(c) Fatty acid amide-based compounds: Stearyl amide, Palmityl amide, Oleic amide, N,N'-hexane-1,6-diyldistearamide, N,N'-Ethylenebis (stearamide), or the like.

(d) Ester compound: Lower alcohol esters of fatty acids, Polyhydric alcohol esters of fatty acids, Polyglycol esters of fatty acids or the like.

(e) Alcohol-based compounds: Cetyl alcohol, Stearyl alcohol, Ethylene glycol, Polyethylene glycol, Polyglycerol, or the like.

(f) Metal soaps: Lead stearate, Cadmium stearate, Barium stearate, Calcium stearate, Zinc stearate, Magnesium stearate, or the like.

(g) Natural wax: Carnauba wax, Candelilla wax, Beeswax, Spermaceti, Ibota wax, Montan wax, or the like.

(h) Others: Silicone compound, Fluorine compound, or the like.

It is acceptable to add an ultraviolet absorber to each layer above. As this ultraviolet absorber, for example, it acceptable to the following items, but the ultraviolet absorber is not limited to these items.

(a) Benzophenones:
2-hydroxy benzophenone,
2,4-dihydroxy benzophenone,
2,2',4-trihydroxybenzophenone,
2,2',4,4'-tetrahydroxy benzophenone,
2,2'-dihydroxy-4-methoxy benzophenone, or the like.

(b) Salicylate-based compounds:
Phenyl salicylate,
2,4-di-tert-butylphenyl-3,5-di-tert-butyl-4-hydroxybenzoate, or the like.

(c) Benzotriazole:
(2'-hydroxyphenyl)benzotriazole,
(2'-hydroxy-5'-methylphenyl)benzotriazole,
(2'-hydroxy-3'-tertiary-butyl-5'-methyl-phenyl)-5-chrolobenzo-triazole, or the like.

(d) Cyanoacrylates:
Ethyl-2-cyano-3,3-diphenylacrylate,
Methyl-2-carbomethoxy-3-(Paramethoxy) acrylate, or the like.

(e) quenchers (Metal complexes):
Nickel [2,2'-thiobis(4-tert-octyl)phenolate]-n-butyl amine,
Nickel dibutyl dithiocarbamate,
Cobalt dicyclohexyl dithiophosphate, or the like.

(f) HALS (Hindered amine):
Bis(2,2,6,6-tetramethyl-4-piperidyl) sebacate,
Bis(1,2,2,6,6-pentamethyl-4-piperidyl) sebacate,
1-[2-[3-(3,5-di-tert-butyl-4-hydroxyphenyl)-propionyloxy]-ethyl]-4-[3-(3,5-di-tert-butyl-4-hydroxyphenyl)propionyloxy]-2,2,6,6-tetramethyl pyridine,
8-benzyl-7,7,9,9-tetramethyl-3-octyl-1,3,8-triazaspiro[4,5] undecane-2,4-dione,
4-benzoyloxy-2,2,6,6-tetramethyl-piperidine, or the like.

It will be explained on the pre-rotation process in the present Embodiment.

Figure 13:
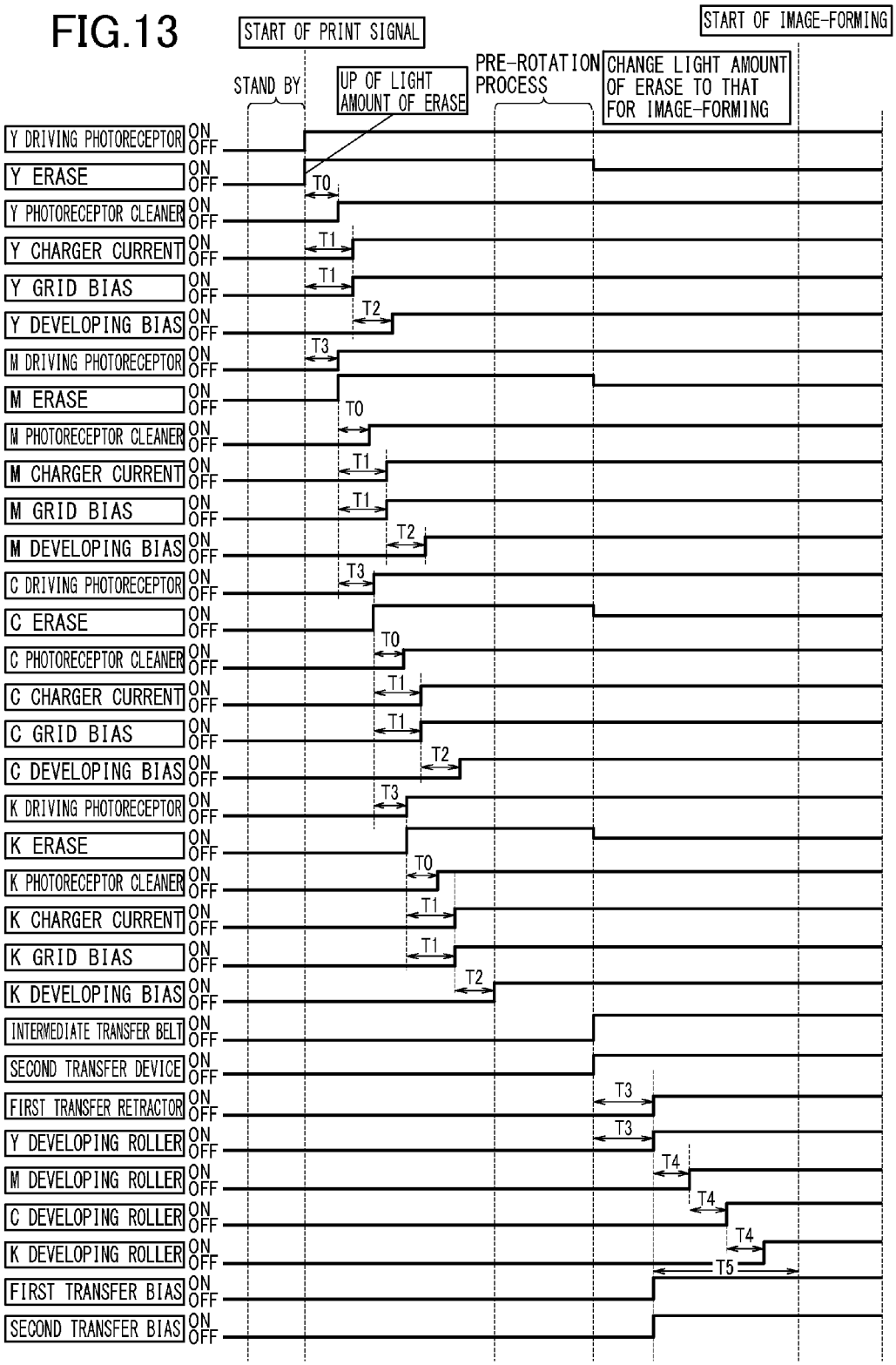
FIG. 13 is a timing chart showing an example of an operation sequence in an image-forming section of the printer in FIG. 1.

FIG. 13 is a timing chart showing one example of an operation sequence in the image-forming sections 102 shown in FIG. 2.

Each unit, the intermediate belt 101 and the second transfer device 111 are waiting until a start signal of (full-color) printing is entered; they are composing each of the image-forming sections 102.

The photoreceptor 202 and the intermediate belt 101 are distanced away from each other; that is, the first transfer retractors 116 are not pushed by the first transfer devices 106 toward the photoreceptors 202, respectively. This condition is termed as "standby condition".

If the start-signal of full-color printing is input, the photoreceptor 202 in the standby condition begins to rotate, and the pre-rotation process is started.

At the same time of the rotation start of this photoreceptor 202, the eraser 207 is turned on. At this time, light amount from the eraser 207 is set larger than that for the image-forming process. In this Embodiment, the light amount is set to about 110 to 200% against that for the image-forming process.

After a predetermined time TO elapses from the time of rotation start of the photoreceptor 202, the cleaner 206 starts driving.

In this Embodiment, the photoreceptor 202 is rotary driven by a stepping motor. After a predetermined time T1 elapses from the time of rotation-start of the photoreceptor 202, the rotation speed of the photoreceptor 202 stabilizes at a target rotational speed.

If the rotation speed of the photoreceptor 202 is stabilized, a charger current which is applied to the grid electrode is turned on and a grid bias which is applied to the grid electrode is turned on. This grid electrode is provided in the charging device 201.

After a predetermined time T2 is elapsed from the timing that the rotational speed of the photoreceptor 202 stabilized, a developing bias is turned on. This developing bias is applied to the developing roller that is provided in the developing device 205.

An operation is carried out in an order of image-forming section 102Y, 102M, 102C, 102K at intervals of predetermined time T3.

This operation is that the photoreceptor 202, the eraser 207, the cleaner 206 and the developing bias are activated and the charger current and the grid bias are turned on.

The reason for the operation above is stem from it threatened to exceed the capacity of the power supply when all of the image-forming sections 102Y, 102M, 102C, 102K started at a same time.

The pre-rotation process is carried out under a direction of the control unit 41 prior to the start of the image-forming process.

The pre-rotation process is one to rotataly drive the photoreceptor 202 without applying the first transfer bias to it while charging it by the charging device 201 and neutralizing it with neutralization light in which the light amount is 110 to 200% of the image-forming process by the eraser 207.

For the pre-rotation process, the charge potential Vd of the photoreceptor 202 is measured by the voltage sensors 210 and the control unit 41 calculates the average $Vd_{avg}(n)$ which is corresponding to one rotation of the photoreceptor 202 with n−1 times rotated.

Here, "n" is a rotation number of the photoreceptor 202 from the rotation start of the photoconductor 202.

Because the voltage sensors 210 measures the charge potential Vd of the photoreceptor 202 during the driving of the photoreceptor 202, the average $Vd_{avg}(n)$ of the charge potentials Vd is calculated every time the photoreceptor 202 rotates one revolution.

The control unit 41 calculates the average $Vd_{avg}(n)$ and also calculates the index value of stability $DV_{stb}$ from the average $Vd_{avg}(n)$. This index value of stability $DV_{stb}$ in the charge potential is an index value of indicating a temporal change of the charge potential Vd.

A formula for calculating the index value of stability $DV_{stb}$ is the next formula (1).

$$DV_{stb}=|Vd_{avg}(n)-Vd_{avg}(n+1)| \quad (1)$$

The index value of stability $DV_{stb}$ in this Embodiment indicates a potential difference between rotations of the photoreceptor 202 rotated n and n+1 times.

However, it is acceptable to use another index value as long as this index value indicates the temporal change of the charge potential Vd of the photoreceptor 202.

In this Embodiment, a rotation number of the photoreceptor 202 in the pre-rotation is calculated from the total number of printing, the index value of stability $DV_{stb}$ and temperature and humidity in a usage environment of the photoreceptor 202.

Figure 14:
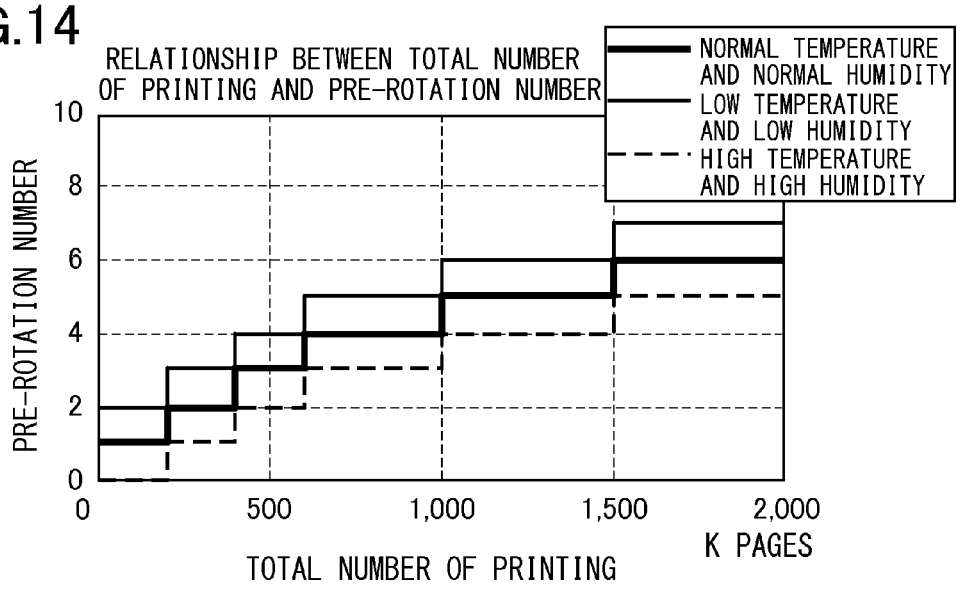
FIG. 14 is a graph showing pre-rotation number in accordance with temperature and humidity in the usage environment and showing the total number of printing.

FIG. 14 is a graph showing the pre-rotation number in accordance with the temperature and humidity in the usage environment and the total number of printing.

In this Embodiment, the pre-rotation number calculated from the temperature and humidity in the usage environment and the total number of printing is assumed as "basic rotation number".

The pre-rotation process is terminated when the index value of stability $DV_{stb}$ reaches under a preset value alpha (a second predetermined reference value) even if the rotation number in the pre-rotation process does not reach the basic rotation number.

However, if the pre-rotation number in the pre-rotation process reaches the basic rotation number before the index value of stability $DV_{stb}$ reaches under a preset value alpha, the photoreceptor 202 is additionally rotated one revolution again. Then, the pre-rotation process is terminated if the index value of stability $DV_{stb}$ reaches under a preset value alpha.

Such the additional rotation number is set to a predetermined rotation number A in this Embodiment.

If the index value of stability $DV_{stb}$ does not reach under a preset value alpha even after the photoreceptor 202 rotates A times additionally, the pre-rotation process is terminated.

This is intended for a case which the photoreceptor surface is in a trouble and the index value of stability $DV_{stb}$ does not reach under a preset value alpha.

After the pre-rotation process, the light amount of the eraser 207 is changed to that for the image-forming process. The intermediate belt 101 and the second transfer device 111 begin to drive.

The first transfer retractor 116 pushes the first transfer device 106 toward the photoreceptors 202 at the same time when the intermediate belt 101 reaches a predetermined rotational speed.

Namely, the first transfer retractor 116 starts an operation to contact the intermediate belt 101 to the photoreceptor 202.

At the same time when the first transfer retractor 116 starts the operation to contact, the developing rollers composed of the developing device 205 starts to drive in an order of Y, M, C, K at intervals of predetermined time T4.

After the intermediate belt 101 contacts the photoreceptor 202, the first and second transfer biases that are applied to the first and second transfer devices respectively are turned on.

The image-forming process starts when a predetermined time T5 elapsed from the time that the first transfer bias turned on.

As described above, the printer according to the present Embodiment is an image-forming apparatus which has the photoreceptor 202 to be rotary driven, the charging device 201 configured to perform a charging process so as to charge the surface of the photoreceptor 202 to a target charge potential, the writing device 203 as an exposure device configured to expose the portion of the surface of the photoreceptor 202, where the charging device 201 electrically charges in order to form a latent image, the developing device 205 configured to develop the latent image using toners to form a toner image, the first transfer device 106 configured to apply an electrical potential with opposite polarity (plus polarity) to that (minus polarity) of a target charge potential to a first transfer roller as a transfer member facing the photoreceptor 202 so as to apply the first transfer bias between the photoreceptor 202 and the first transfer device 106, and to perform the first transfer process of the toner image on the photoreceptor 202 onto the intermediate belt 101 as the body to be transferred by the first transfer bias, the eraser 207 as a neutralizer configured to irradiate with neutralization light the surface of the photoreceptor 202 on which the toner image is transferred by the transfer device 106 so as to neutralize the surface, and the main control unit 41 configured to perform the pre-rotation process of rotary driving of the photoreceptor 202 in a condition of not applying the first transfer bias while performing the neutralization by the eraser 207 and while performing the charge process by the charging device 201, before starting to form the electrostatic latent image by the writing device 203, and maintain the pre-rotation process by rotataly driving the photoreceptor 202 up to the number of rotation times in which the absolute value of the electrostatic charge (charge potential) Vd of the photoreceptor 202 reaches a first predetermined reference value or more. This "first predetermined value" is determined in advance from the characteristics of the photoreceptor and the bias setting of the image-forming system by experiment. This value is memorized and stored in the main control device 41 in advance.

The main control unit 41 maintains the pre-rotation process by rotataly driving the photoreceptor 202 up to the number of rotation times in which the temporal change of the charge potential Vd of the photoreceptor 202 reaches a preset value alpha or less even after reaching the number of rotation times in which the absolute value of the charge potential Vd of the photoreceptor 202 reaches the first predetermined reference value or more.

Herewith, it is possible to start an image-forming process from the time point that the electrical potential (residual potential) VL of the exposure section of photoreceptor 202 is stabilized.

Especially, in this Embodiment, the voltage sensor 210 is provided as a measuring device to measure the charge potential Vd of the photoreceptor 202.

Figure 15:
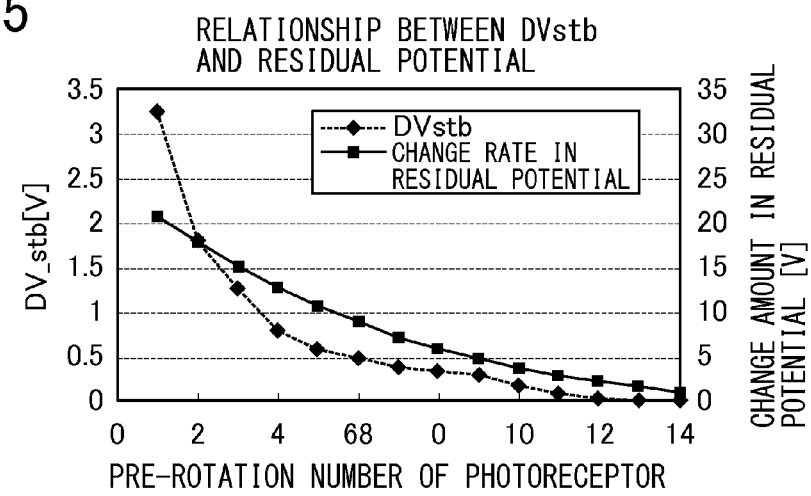
FIG. 15 is a graph showing a relationship between an amount of change in the residual potential and index value of stability, $DV_{stb}$.
Figure 16:
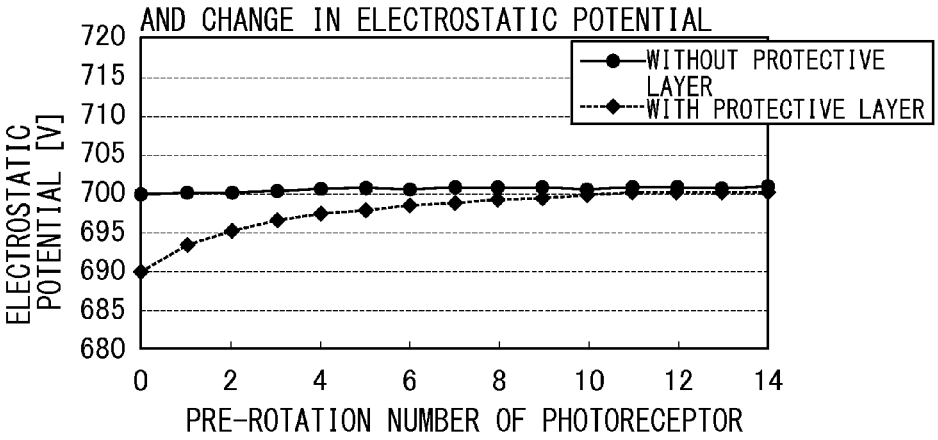
FIG. 16 is a graph showing relationships between an charge potential v.s. a pre-rotation number of the photoreceptor with or without the protective layer, respectively.
Figure 17:
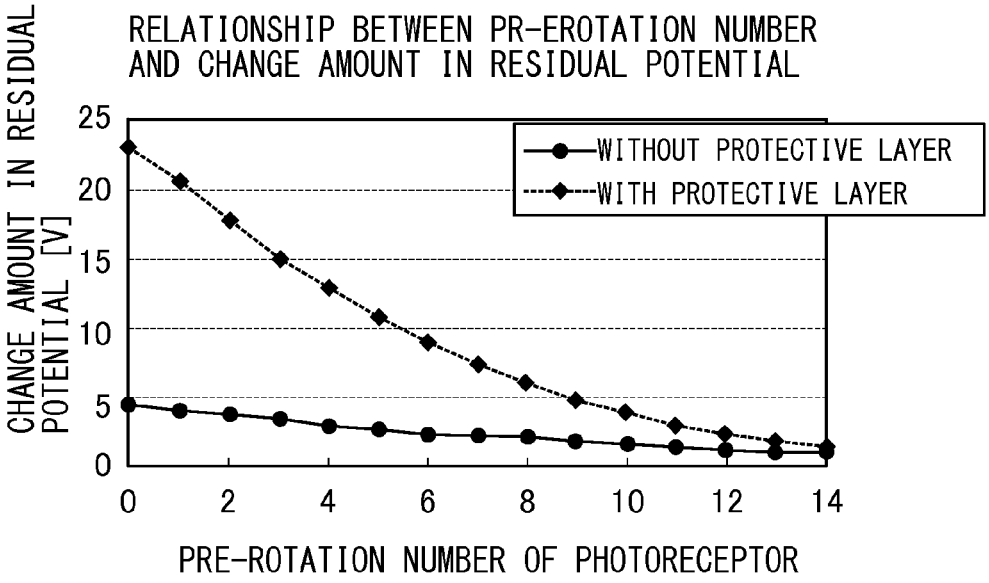
FIG. 17 is a graph showing relationships between an amount of change in the residual potential (of the latent image section) v.s. a pre-rotation number of the photoreceptor with or without the protective layer, respectively.
Figure 18:
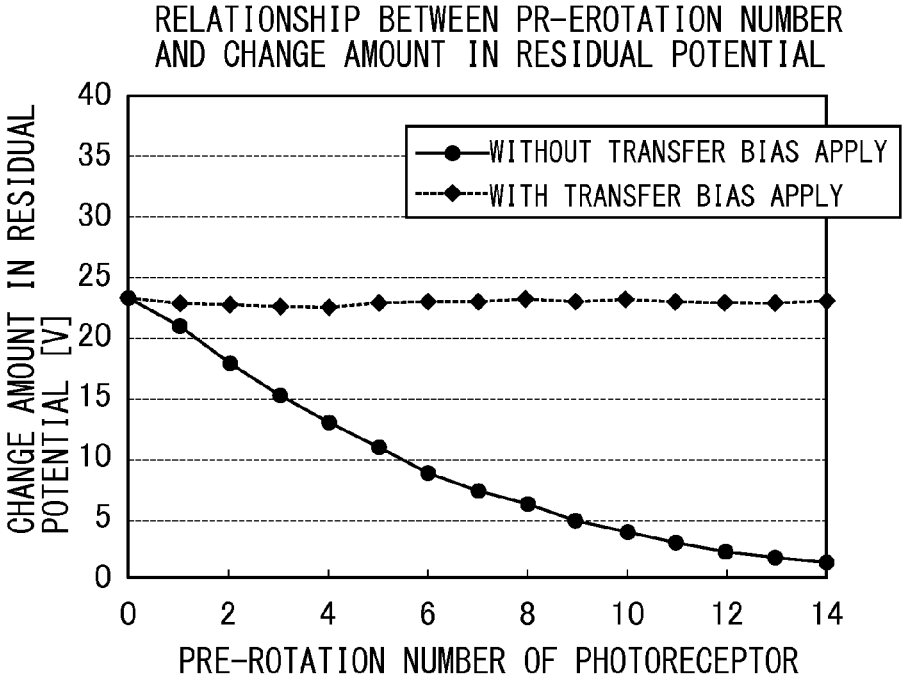
FIG. 18 is a graph showing relationships between an amount of change in the residual potential (of the latent image section) v.s. a pre-rotation number of the photoreceptor with or without applying the first transfer bias.

Assuming an average electrical potential on the photoreceptor surface as $Vd_{avg}(n)$, which is corresponding to one rotation of the photoreceptor with n−1 times rotated and which is obtained from a result of the measurement by the voltage sensor 210 in the pre-rotation process, the pre-rotation process is maintained by rotataly driving the photoreceptor 202 up to the number of rotation times in which the index value of stability $DV_{stb}$ as the index value indicating the temporal change above reaches the preset value alpha or less, that the index value of stability $DV_{stb}$ is obtained from the formula (1) above, FIG. 15 is a graph showing a relationship between an amount of change in the residual potential and index value of stability, $DV_{stb}$.

As shown in this graph, if an amount of change in the residual potential becomes small and the residual potential is in a range close to the steady state, a correlation is high between the amount of change in the residual potential and the index value of stability, $DV_{stb}$.

Therefore, by using stability $DV_{stb}$ as index value indicating the temporal change in the charge potential of the photoreceptor 202, it is possible to grasp simply and with a high degree of accuracy the time point that the electrical potential (residual potential) VL of the exposure section of photoreceptor 202 is stabilized. Herewith, it is possible to start the image-forming process from the time point.

In this Embodiment, the first transfer retractor 116 as a device to contact and separate the photoreceptor 202 and the intermediate belt 101 is provided so that the pre-rotation process is carried out in a condition in which the photoreceptor 202 is distanced from the intermediate belt 101 by the first retractor 116.

Herewith, it is possible to extend the life of the intermediate belt 101 compared to performing the pre-rotation process in a condition in which the photoreceptor 202 is in contact with the intermediate belt 101.

In addition, in this Embodiment, the main control unit 41 functions as a counter for counting a total rotation number of the photoreceptor 202.

This main control unit 41 terminates the pre-rotation process when the rotation number of the photoreceptor 202 in the pre-rotation process reaches a maximum rotation number (basic rotation number+additional rotation number A) which is determined in accordance with the total rotation number from the counter even if the index value of stability $DV_{stb}$ is not a preset value alpha or less.

Herewith, it is possible to avoid a situation that the pre-rotation process does not end due to the trouble of the photoreceptor surface.

In addition, in this Embodiment, the printer has temperature and humidity sensors 208 as a detecting device configured to detect temperature and/or humidity in a usage environment of the photoreceptor 202, This main control unit 41 terminates the pre-rotation process when the rotation number of the photoreceptor 202 in the pre-rotation process reaches a maximum rotation number (basic rotation number+additional rotation number A) which is determined in accordance with results of detections by the temperature and humidity sensors 208 even if the index value of stability $DV_{stb}$ is not a preset value alpha or less.

Herewith, it is possible to avoid a situation that the pre-rotation process does not end due to the trouble of the photoreceptor surface In the present Embodiment, the output value (the amount of exposure) of the neutralization light irradiated on the surface of the photoreceptor 202 during the pre-rotation process by the eraser 207 is more than that for the image-forming process.

Herewith, it is possible to stabilize the electrical potential (residual potential) VL of the exposure section of photoreceptor 202 more speedily and to promptly terminate the pre-rotation process to start the image formation process.

In this Embodiment, the photoreceptor 202 is one that the photoreceptive layers 202B, 202C, 202D are provided on the conductive supporting body as conductive support member 202A and the protective layer 202E containing the fluorine resin powder is provided as the outermost surface layer.

Such a photoreceptor 202 is advantageous in terms of accomplishing higher image quality and resolution.

In order to suppress image quality degradation caused by the start of the image formation before the residual potential is stabled while suppressing the short life of the photoconductor by the pre-rotation process of the photoreceptor, it is necessary to start the image-forming process from the time point that the residual potential of the photoreceptor is stabilized.

To achieve this, it is necessary to grasp the time point that the residual potential of the photoreceptor is stabilized.

It is possible to determine directly whether or not the residual potential of the photoreceptor is stabilized by the exposing for the latent image on the surface of the photoconductor similar to the exposure for the image-forming process after the charge process of the photoconductor and the measuring of the residual potential of the exposure section, However, in this case, the surface is exposed as well as the image-forming process during the pre-rotation process of forming no image.

Photoreceptor progresses its degradation by being exposed, therefore, the exposure carried out during the pre-rotation process makes the life of the photoreceptor short.

Therefore, from the point of view of suppressing the shortening caused by the pre-rotation process of the photoreceptor, it is necessary to grasp the time point the residual potential of the photoreceptor is stabilized under a condition of no exposure during the pre-rotation process.

The present inventors found out as a result of extensive studies that a temporal change in the residual potential of the photoreceptor is within an acceptable range and the residual potential of the photoreceptor is stabilized when a temporal change in the charge potential of the photoreceptor reaches a preset value alpha or less.

This preset value is smaller than a value corresponding to a temporal change when the electrostatic of the photoreceptor reaches the first predetermined reference value or more and within a range of the target charge potential.

In the present Embodiment, based on the above findings, the pre-rotation process is maintained by rotataly driving the photoreceptor up to the number of rotations in which the temporal change in the charge potential of the photoreceptor reaches a preset value alpha or less even after the absolute value of the electrostatic charge of the photoreceptor reaches the first predetermined reference value or more.

Herewith, it is possible to perform image-forming process from the time point that the residual potential of the photoreceptor is stabilized.

Therefore, it is possible to prevent the short life of the photoreceptor by the pre-rotation process and suppress a degradation of image quality caused by the start of the image-forming process before the residual potential is stabilized.

What is claimed is:

1. An image-forming apparatus, comprising:

a rotatable photoreceptor;

a charging device configured to charge a surface of the photoreceptor to be a target charge potential;

an exposure device configured to expose a charged portion on the surface of the photoreceptor to form an electrostatic latent image;

a developing device configured to develop the electrostatic latent image using toner to form a toner image;

a transfer device configured to apply a transfer bias between the photoreceptor and a transfer member by applying an electrical potential of opposite polarity to the target charge potential to the transfer member facing the photoreceptor, and transfer the toner image on the photoreceptor onto a body to be transferred by the transfer bias;

a neutralization device configured to neutralize the surface of the photoreceptor by irradiating the surface with neutralization light after the transferring; and a pre-rotation device configured to perform a pre-rotation process which rotates and drives the photoreceptor without applying the transfer bias while performing the charging process by the charging device and the neutralization process by the neutralization device before the formation of the electrostatic latent image by the exposure device, and to maintain the pre-rotation process up to the number of rotation times in which an absolute value of the charge potential of the photoreceptor becomes a first predetermined reference value or more, wherein the pre-rotation device maintains the pre-rotation process up to the number of rotation times in which a temporal change in the charge potential of the photoreceptor becomes a second predetermined reference value or less after reaching the number of rotation times in which the absolute value of the charge potential of the photoreceptor becomes the first predetermined reference value or more.

2. The image-forming apparatus according to claim 1, further comprising:

a measuring device configured to measure the electrical potential of the photoreceptor, wherein the pre-rotation device maintains the pre-rotation process up to the number of rotation times in which an index value $DV_{stb}$ indicating the temporal change obtained from the following next formula (1) becomes the second predetermined reference value or less, where an average electrical potential on the photoreceptor surface is $Vd_{avg}(n)$, where this $Vd_{avg}(n)$ corresponds to one rotation of the photoreceptor with n−1 times rotated, and is being obtained from a result of measurement by the measuring device in the pre-rotation process.

$$DV_{stb}=|Vd_{avg}(n)-Vd_{avg}(n+1)| \quad (1)$$

3. The image-forming apparatus according to claim 1:

wherein the body to be transferred is an intermediate transfer body, the image-forming apparatus further comprises a contact-separating device configured to contact and separate the intermediate transfer body against the photoreceptor; and the pre-rotation device performs the pre-rotation process under a condition in which the photoreceptor is distanced from the intermediate transfer body by the contact-separating device.

4. The image-forming apparatus according to claim 1, further comprising:

a counter configured to count a total rotation number of the photoreceptor, wherein the pre-rotation device is configured to finish the pre-rotation process when the pre-rotation number of the photoreceptor in the pre-rotation process reaches a maximum rotation number, even if the temporal change does not reach the second predetermined value or less, the maximum rotation number being determined in accordance with the total rotation number.

5. The image-forming apparatus according to claim 1, further comprising:

a detecting device configured to detect temperature and/or humidity in a usage environment of the photoreceptor, wherein the processing device finishes the pre-rotation process when the pre-rotation number of the photoreceptor in the pre-rotation process reaches a maximum rotation number, even if the temporal change does not reach the second predetermined value or less, the maximum rotation being determined in accordance with a result detected by the detecting device.

6. The image-forming apparatus according to claim 1, wherein an output value of the neutralization light output by the neutralization device during the pre-rotation process is larger than that for an image-forming process.

7. The image-forming apparatus according to claim 1, wherein the photoreceptor has a conductive support-member and a photoreceptive layer, the photoreceptive layer being formed on the conductive support-member, a protective layer made of fluorine resin is provided in the conductive-support member as the outer most layer.

8. A method for forming an electrostatic latent image, performed by the image forming apparatus of claim 1.

9. A method for forming an electrostatic latent image, performed by the image forming apparatus of claim 2.

* * * * *